US010874226B2

(12) United States Patent
Bauer et al.

(10) Patent No.: US 10,874,226 B2
(45) Date of Patent: Dec. 29, 2020

(54) PACKAGING DISPENSER

(71) Applicant: Prince Castle LLC, Carol Stream, IL (US)

(72) Inventors: Richard Bauer, Palatine, IL (US); Chris Sweeney, Chicago, IL (US); Eugene S. Maslana, Arlington Heights, IL (US); Forrest Duvick, Cortland, IL (US); Brian Smetana, Downers Grove, IL (US); Marcus Frio, St. Charles, IL (US)

(73) Assignee: Prince Castle LLC, Carol Stream, IL (US)

( * ) Notice: Subject to any disclaimer, the term of this patent is extended or adjusted under 35 U.S.C. 154(b) by 0 days.

(21) Appl. No.: 16/239,999

(22) Filed: Jan. 4, 2019

(65) Prior Publication Data

US 2019/0208924 A1 Jul. 11, 2019

Related U.S. Application Data

(60) Provisional application No. 62/669,674, filed on May 10, 2018, provisional application No. 62/614,018, filed on Jan. 5, 2018.

(51) Int. Cl.
*A47F 1/08* (2006.01)
*B65B 67/02* (2006.01)

(52) U.S. Cl.
CPC ..... *A47F 1/085* (2013.01); *B65B 67/02* (2013.01); *B65B 2220/02* (2013.01)

(58) Field of Classification Search
CPC ..... A47F 1/085; A47F 7/0071; B65B 67/02; B65B 2220/02
USPC ..... 221/33–63
See application file for complete search history.

(56) References Cited

U.S. PATENT DOCUMENTS

| | | | | |
|---|---|---|---|---|
| 846,683 | A * | 3/1907 | Moore | B65D 71/36 221/305 |
| 1,007,546 | A * | 10/1911 | Durrum | A24F 27/16 221/137 |
| D218,244 | S | 8/1970 | Hansen | |
| D286,121 | S | 10/1986 | Wolff | |
| D289,840 | S | 5/1987 | Burkes | |
| D293,416 | S | 12/1987 | Krueger | |
| D301,304 | S | 5/1989 | Will | |
| D317,157 | S | 5/1991 | Jondelius | |
| D320,027 | S | 9/1991 | Mintz et al. | |
| 5,054,672 | A | 10/1991 | Weissman | |
| D321,885 | S | 11/1991 | Sheldrake | |
| D408,721 | S | 4/1999 | Sartini | |
| D429,864 | S | 8/2000 | Schmidt | |
| 6,334,544 | B1 * | 1/2002 | Christensen | A47K 10/424 221/303 |
| D487,867 | S | 3/2004 | Balaban | |
| D548,051 | S | 8/2007 | Ruppert et al. | |
| D556,016 | S | 11/2007 | Curtas | |

(Continued)

*Primary Examiner* — Gene O Crawford
*Assistant Examiner* — Ayodeji T Ojofeitimi
(74) *Attorney, Agent, or Firm* — Andrus Intellectual Property Law, LLP

(57) ABSTRACT

Packaging dispensers are configured to retain various types of packaging in which prepared food items are placed prior to delivery to a customer. The packaging dispensers retain a plurality of a packaging type as a supply of the packages. The packaging dispensers facilitate withdrawal of a single package from the supply of the packages.

16 Claims, 15 Drawing Sheets

(56) References Cited

U.S. PATENT DOCUMENTS

| | | | | |
|---|---|---|---|---|
| D563,771 | S | 3/2008 | Prechtel et al. | |
| D568,728 | S | 5/2008 | Zadak et al. | |
| D598,690 | S | 8/2009 | Ackland | |
| D618,992 | S | 7/2010 | Rix | |
| 8,857,660 | B2 * | 10/2014 | Omdoll | A47F 7/0071 221/307 |
| 8,910,826 | B2 * | 12/2014 | Rapala | A47K 10/185 206/233 |
| D733,531 | S | 7/2015 | Tonthat et al. | |
| D735,770 | S | 8/2015 | Schaffert | |
| D759,466 | S | 6/2016 | Tonthat et al. | |
| D768,466 | S | 10/2016 | Simmons et al. | |
| D808,171 | S | 1/2018 | Trost | |
| D815,459 | S | 4/2018 | Mann | |
| D822,458 | S | 7/2018 | Campbell | |
| 2004/0089671 | A1 * | 5/2004 | Miller | B65D 5/5405 221/305 |
| 2009/0139998 | A1 * | 6/2009 | Guthrie, Jr. | A47F 1/085 221/1 |
| 2013/0223971 | A1 | 8/2013 | Grace, IV | |

* cited by examiner

PACKAGING DISPENSER

CROSS REFERENCE TO RELATED APPLICATION

The present application claims priority to U.S. Provisional Patent Application No. 62/614,018, filed on Jan. 5, 2018 and U.S. Provisional Patent Application No. 62/669,674 filed on May 10, 2018. The contents of each application are hereby incorporated herein by reference in their entireties.

BACKGROUND

The present disclosure relates to the field of food preparation in a restaurant setting. More specifically, the present disclosure relates to dispensing of packaging into which prepared food items can be placed prior to being given to the customer.

In many restaurant settings, particularly in quick service restaurants, ordered food items, for example sandwiches, hamburgers, French fries, chicken nuggets, salad, are placed in packaging after the food is prepared, but prior to the customer receiving the assembled order. Two common forms of packages include boxes and paper wraps. Boxes may exemplarily be constructed of cardboard or a polymer material and define a volumetric space within which the prepared food item is placed. The boxes may be of a clamshell design with a living hinge between top and bottom portions constructed of the same material as the hinge. Other foods are commonly wrapped in a sheet of paper, this paper may be printed with an identification of the food product contained therein (e.g. cheeseburger or burrito). The paper may be any of a variety of types of paper known in the industry and to a person of ordinary skill in the art, and exemplarily includes paper that has been treated with an oil resistant coating.

As restaurants become more specialized in their product offerings, these product offerings frequently require specialized packaging either to accommodate for various sizes of orders or to differentiate specialty order items, and to provide an identification of the food item once it is packaged so that a customer's entire order can be properly assembled with the correct food items before delivery to the customer. The increases in the types, sizes, and variety of food packaging presents a challenge to properly and efficiently store all of these types of packaging in a manner in which they are easily accessed by food service workers, yet require minimal space as space is often at a premium in confined kitchen environments.

BRIEF DISCLOSURE

An exemplary embodiment of a dispenser of food product packaging is configured to dispense food product packaging in the form of a box blank that is arranged in a flat storage condition with a front face in contact with a rear face. The dispenser includes a first side wall that extends vertically and a second side wall that extends vertically. A front wall extends vertically between the first side wall and the second side wall. The front side includes a first bottom edge and a second bottom edge. An angled bottom includes a first angled portion connected to the first side wall and a second angled portion connected to the second side wall. The angled bottom is spaced apart from the first bottom edge and the second bottom edge to form a dispensing slot. The first side wall, second side wall, front side, and angled bottom defined a dispenser interior that is dimensioned to receive a plurality of folded boxes in the flat storage condition.

The dispenser may include a first arm extending away from the first side wall and a second arm extending away from the second side wall. The first arm and the second arm may be configured for mounting the dispenser to an object. The first arm may be pivotably attached to the first side wall and the second arm may be pivotably attached to the second side wall. The first arm may be integrally afformed with the first side wall and the second arm may be integrally formed with the second side wall. Embodiments may also include a mounting bracket and the first arm and the second arm are secured to the mounting bracket and the mounting bracket is configured to mount the dispenser to the object. In additional exemplary embodiments, the dispenser may include a first dispenser half that includes the first side wall, the first angled portion and a first face portion that includes the first bottom edge. A second dispenser half includes the second side wall, the second angled portion, and a second faced portion that includes the second bottom edge. The front side includes the first face portion and the second face portion, the angled bottom includes the first angled portion and the second angled portion. The first dispenser half is laterally separated from the second dispenser half.

An exemplary embodiment of a dispenser of food product packaging is configured to dispenser product packaging in the form a wrapper. The dispenser includes a first side wall extending vertically and a second side wall extending vertically and opposed from the first side wall. A floor extends horizontally between the first and second side walls. A first end finger assembly extends from an end of the first side wall in the direction of the second side wall. A second end finger assembly extends from an end of the second side wall in the direction of the first side wall. The first and second end finger assemblies are asymmetrical in construction and are configured to engage the wrapper to resist removal of the wrapper from between the first and second side walls.

The first end finger assembly may include a horizontally extending lower finger and an upwardly angled upper finger. The second end finger assembly may include a downwardly angled lower finger and an upwardly angled upper finger. The dispenser may also include a first flange that extends inwardly from a top of the first side wall in the direction of the second side wall and a second flange that extends inwardly from a top of the second side wall in the direction of the first side wall. The first and second flanges are configured to engage a portion of the wrapper to double portions of the wrapper back upon the wrapper between the first and the second side walls.

Exemplary embodiments of the dispenser may include a first dispenser and may be configured to inter connect with a second dispenser and the first and second dispensers include projections that extend upward from the first and second flanges and slots formed in the floors of the dispensers where the slots are parallel to the first and second side walls and the slots are configured to receive and retain projections from the second dispenser when the second dispenser is positioned below the floor of the first dispenser. Embodiments of the dispenser may also include a third end finger assembly that extends from an end of the first side wall opposite the first end finger assembly in the direction of the second wall and a fourth finger assembly extending from an end of the second side wall opposite the second end finger assembly in the direction of the first side wall.

An exemplary embodiment of a dispenser of food product packaging for food product packaging that is in the form of a box having a compartment and a closure flap. Embodiments of the dispenser include a back plate and first and second side walls that extend outward from the sides of the back plate. A first channel is defined into the first side wall between the back plate and a front plate of the first side wall. A second channel is defined into the second side wall between the back plate and a front face of the second side wall. The dispenser may include a first ramp that is located within the first channel and a second ramp that is located within the second channel and the first and second ramps narrow a lateral distance between the first and second side walls. Embodiments of the dispenser may include a funnel with first and second forward flares that extend in a direction away from the back plate in a depth dimension. In a further exemplary embodiment, the funnel may further include first and second side flares and the first side flare extends laterally away from the second side flare. The back plate may be concave. Embodiments of the dispenser may further include a cover that includes an engagement body configured to be inserted into the compartment of the box. The cover includes a shelf that extends outward from an outer extent of the engagement body. At least one tab of the cover is configured to engage the back plate or side walls to retain the cover to the back plate or the side walls.

DETAILED DISCLOSURE

Figure 1:
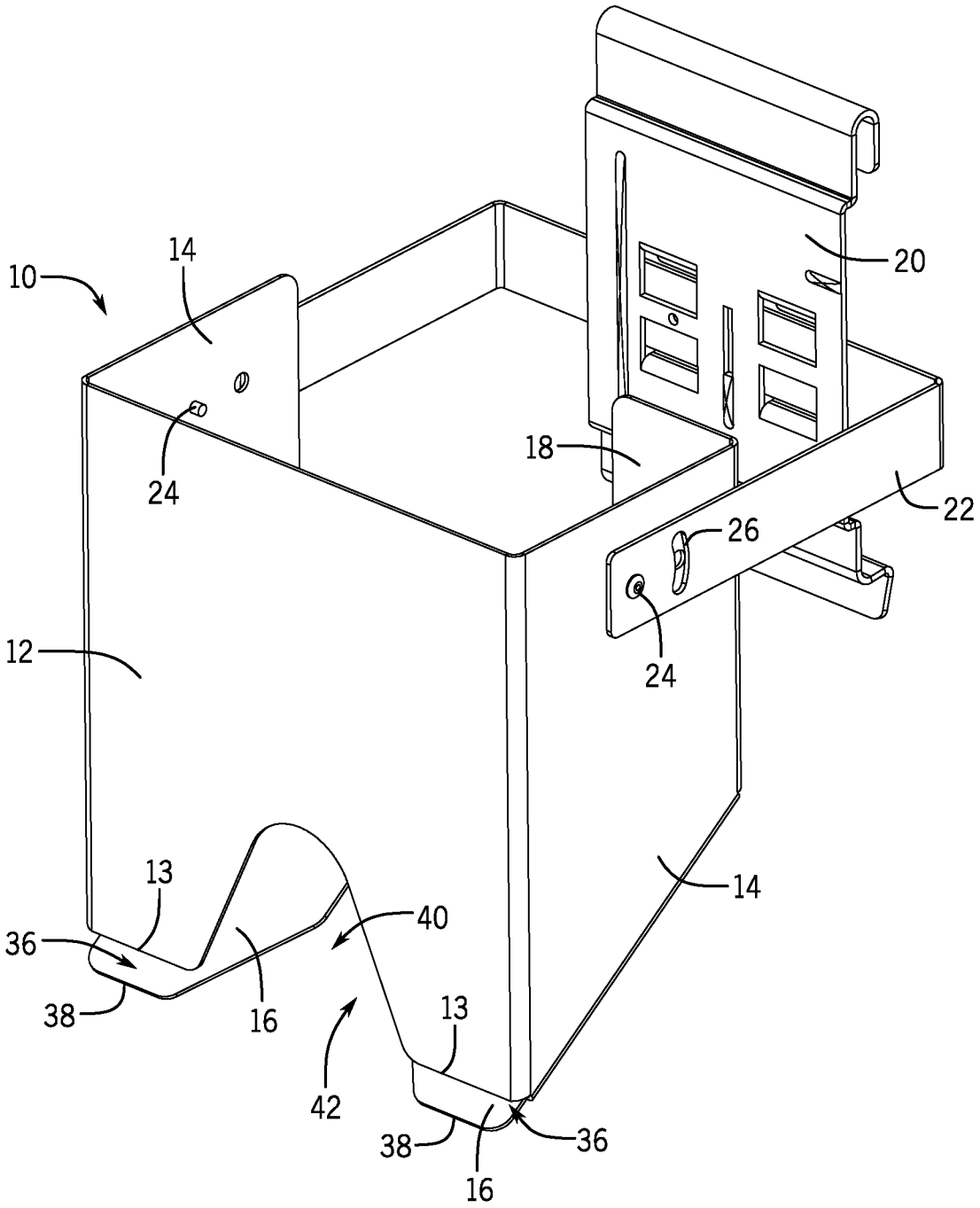
FIG. 1 depicts an exemplary embodiment of a box blank dispenser.

FIG. 1 depicts an exemplary embodiment of a box blank dispenser 10. The box blank dispenser 10 includes a front wall 12 and side walls 14. The box blank dispenser 10 further includes angled portions 16. A back wall 18 partially extends across a back of the box blank dispenser 10. The front wall 12, side walls 14, angled portions 16 and the back wall 18 may all be formed of a single piece of metal that is bent to form the box blank dispenser 10. In other embodiments, the box blank dispenser 10 may be assembled from multiple components secured by fasteners, welding, or the like, or may be formed from injection molding or polymeric materials or other manufacturing techniques.

The box blank dispenser 10 may further include a mounting bracket 20, which is configured to secure to a shelf, wall, cabinet, or other piece of equipment. In an exemplary embodiment, the mounting bracket 20 is configured to secure the box blank dispenser 10 to a wire frame shelf or rack (not depicted). Support arms 22 extend from the mounting bracket 20 and are pivotably fixed to the side walls 14 at pivot pins 24. An adjustment slot 26 in the support arms 22 provide for an angular adjustment of the side walls 14, front wall 12, and angled portions 16 relative to the support arms 22 and the mounting bracket 20. A set screw (not depicted) can secure through the respective support arm 22 and the side wall 14 at the adjustment slot 26 to fix this relative positioning.

Figure 2:
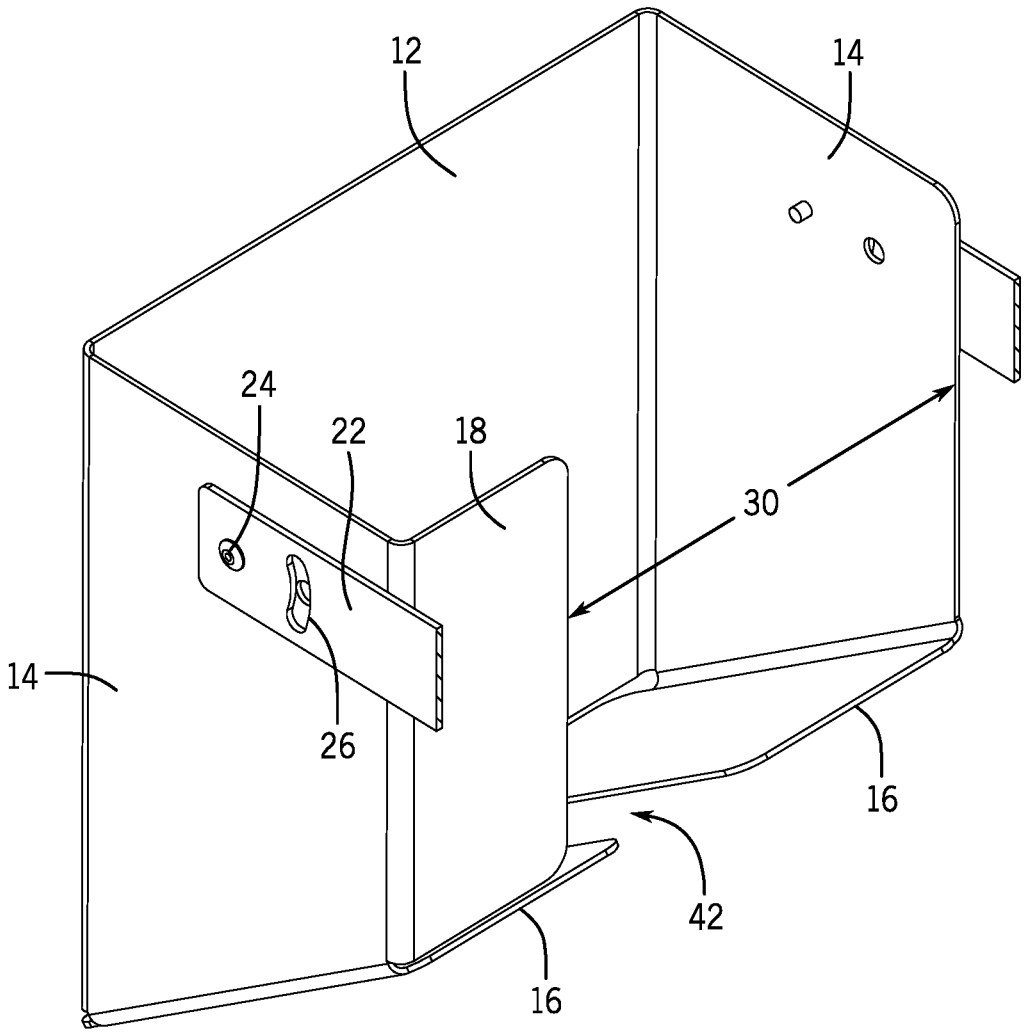
FIG. 2 is a rear perspective view of the box blank dispenser.
Figure 3:
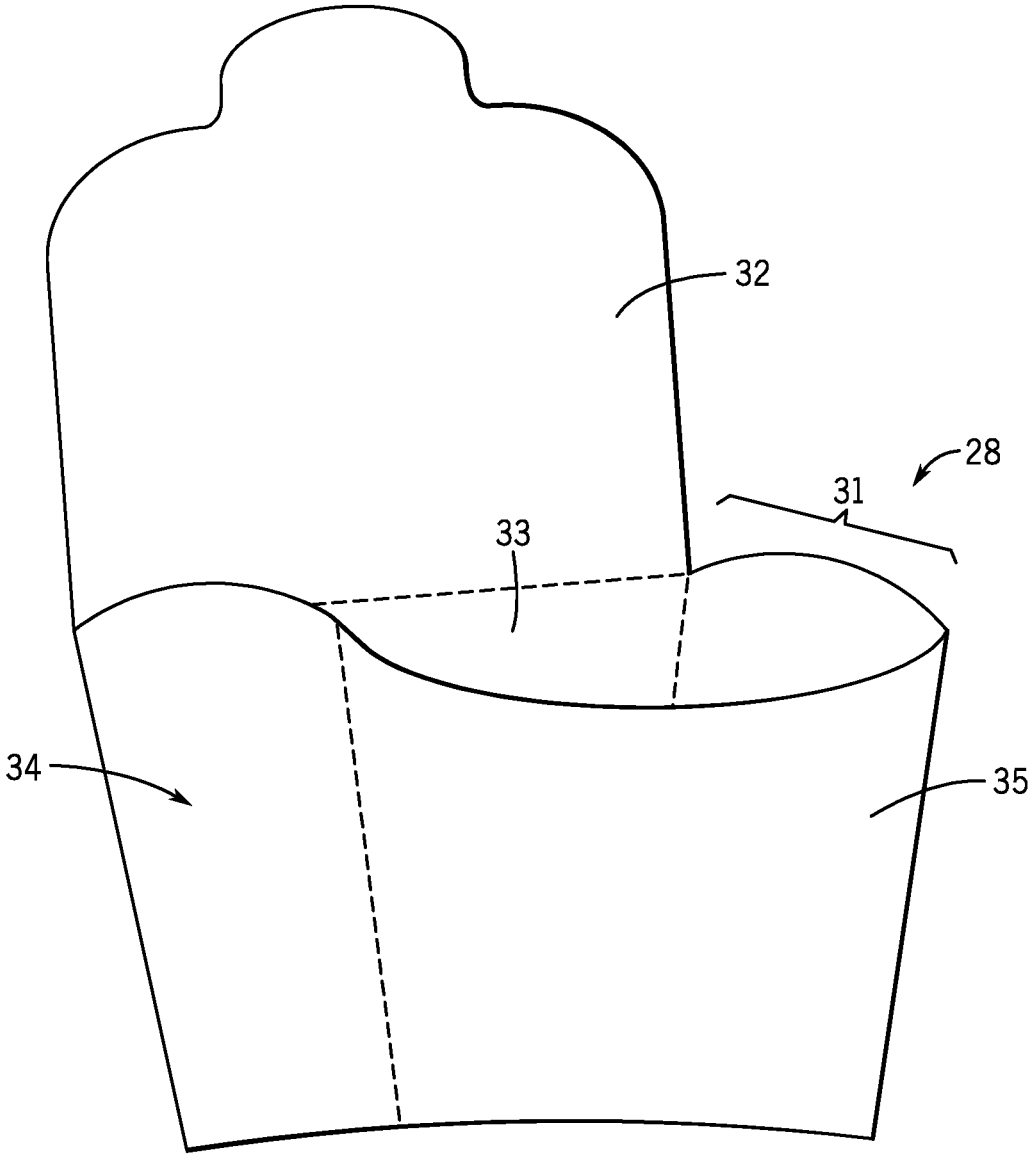
FIG. 3 depicts an exemplary embodiment a box blank.
Figure 4:
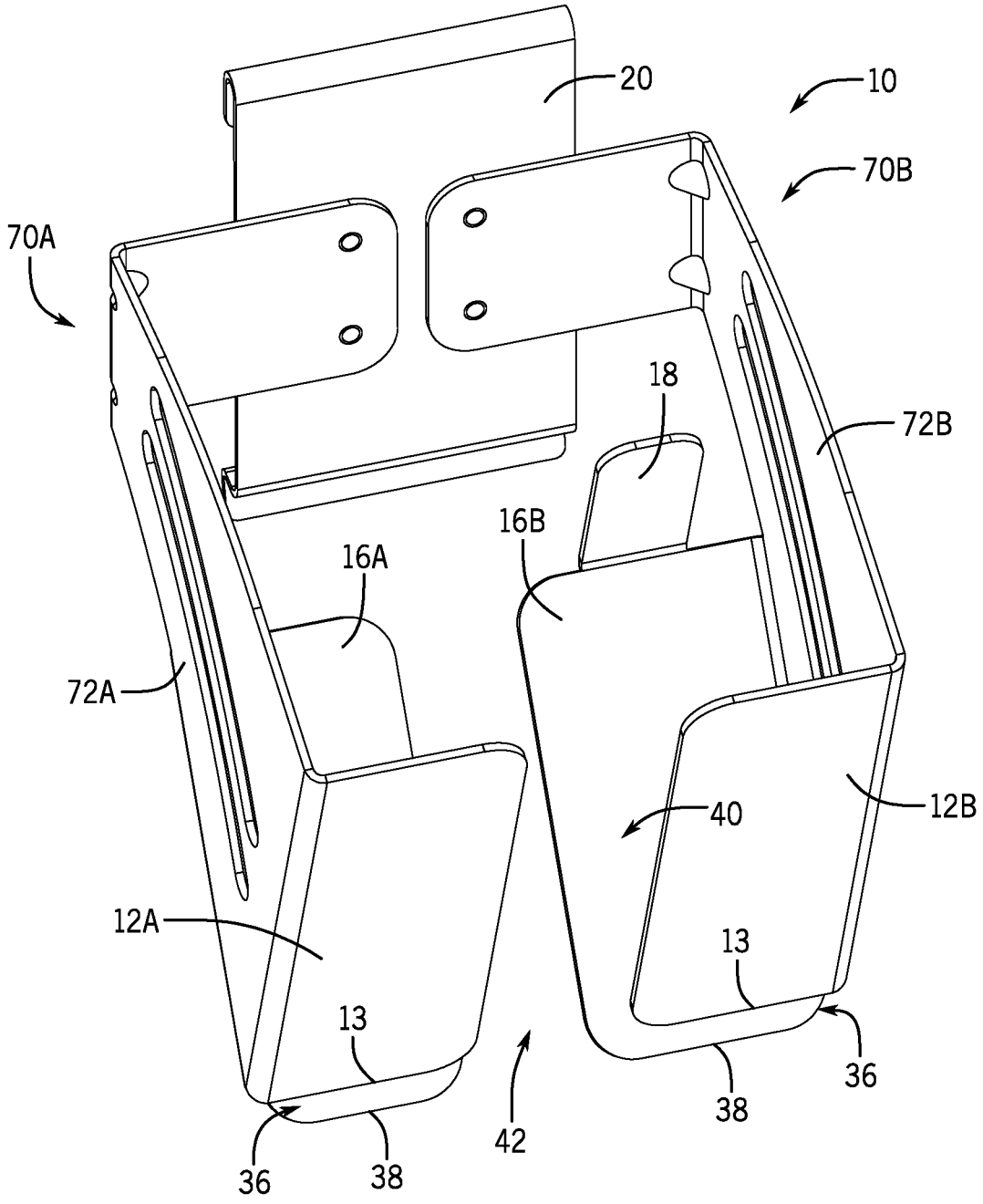
FIG. 4 is a top perspective view of an exemplary embodiment of a box blank dispenser.

FIG. 2 is a rear perspective view of the box blank dispenser 10 with the bracket 20 removed and the support arms 22 partially removed. This view shows the back wall 18 which only partially extends across the width of the box blank dispenser 10. The back wall 18 is connected to and extends from the side wall 14. This defines an interior space 25 within the box blank dispenser 10 that is configured to receive a plurality of box blanks 28, an example of which is depicted in FIG. 4. In an exemplary embodiment, the box blank 28 is foldable into a box container that is able to receive one or more food items. In an exemplary embodiment, the box may be configured and dimensioned to receive 4, 6, or 10 chicken nuggets. However, it will be recognized that other foods, numbers, and/or volumes may be accommodated with such box container embodiments. The box blank 28 includes a closure flap 32 and a container portion 34. The container portion 34 includes a back wall 33 and a front wall 35, and when the box blank 28 is in a flattened condition, at least a portion of the back wall 33 and the front wall 35 are in overlapping contact with each other to eliminate the interior volume of the container portion 34. When folded in this manner, a portion 31 of the container portion 34, including some of the front wall 35, extends beyond a width of the closure flap 32.

Referring back to FIG. 2, the partial width of the back wall 18 leaves open a space 30 through which the lid portion 32 of the box blank (FIG. 4) can extend while a plurality of box blanks are received in a stacked fashion within the box blank dispenser 10. The lowermost box blank rests upon the angled portions 16 and the stack of box blanks are held generally at a downward angle. The full width between the side walls 14 accommodate the width of the flat box blank, with the shortened width back wall 18 engaging an edge of the box blank 28 along the portion 35 from which the lid 32 does not extend. The box blanks 28 are loaded into the box blank dispenser 10 from the top.

The front wall 12 defines two bottom edges 13. A dispensing slot 36 is defined between the side bottom flanges 16 and the respective two bottom edges of the front wall 12. The dispensing slot 36 is exemplarily dimensioned to be greater than the flattened height of one box blank, but less than two times this flattened height. In this manner, a user is able to pull a single box blank from the bottom of the stack of box blanks held within the box blank dispenser 10. As best seen in FIG. 1, the side bottom flanges 16 extend outward beyond the front wall 12 in what is indicated as lip 38. However, it will be recognized that lips 38 may exemplarily be integral portions of the side bottom flanges 16. The lips 38 provide additional support for a lowermost box blank to partially extend through the dispensing slot and exterior of a plane of the front wall 12. This can help to provide a portion of the lowermost box blank for the user to grip while removing the lowermost box blank. The box blank dispenser 10 further includes front aperture 40 through the front wall 12 and bottom aperture 42 between the angled bottom portions 16. The bottom aperture 42 may extend entirely between the angled bottom portions 16. These apertures 40, 42 further facilitate access to the box blanks with the fingers of a user to grip the lowermost box blank for removal through dispensing slot 36. The front aperture 42 further provides a visual indication as to the remaining inventory of box blanks within the dispenser 10.

Figure 5:
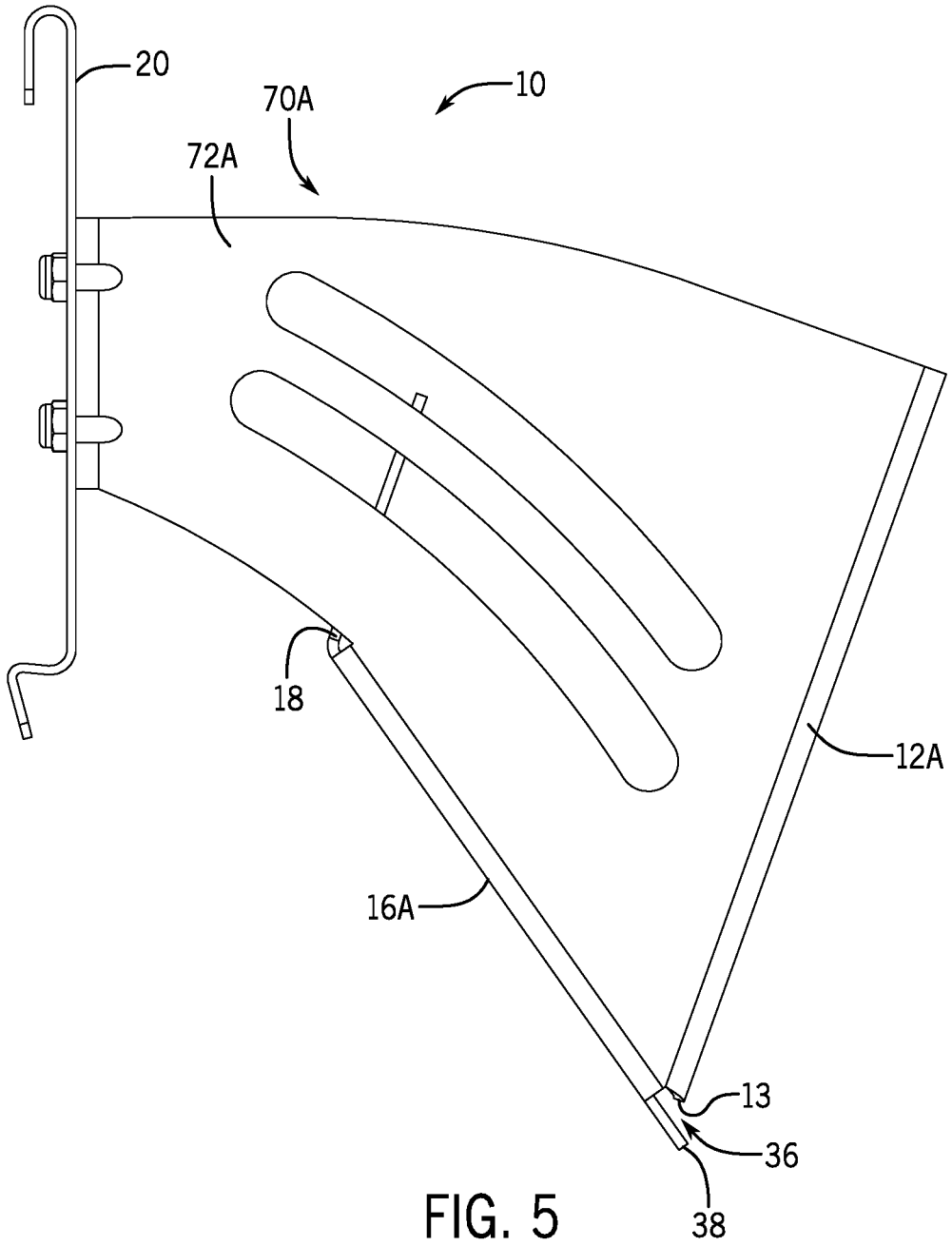
FIG. 5 is a side view of the box blank dispenser.

FIGS. 4 and 5 depict another exemplary embodiment of a box blank dispenser 10. The box blank dispenser 10 includes many of the same features as that described above with respect to FIGS. 1 and 2 and like reference numbers will be used to refer to like structures between the embodiments. The box blank dispenser 10 is divided into two dispenser halves 70A and 70B. The dispenser halves 70A, 70B each include respective side walls 72A, 72B, front wall portions 12A, 12B, and respective angled bottom portions 16A, 16B. The front aperture 40 and the bottom aperture 42 extend the entire distance between the dispenser halves 70A and 70B. Dispenser half 70B further includes the back wall 18, which extends upwards from the angled bottom portion 16B.

The side walls 72A, 72B are integrated with the arms as described above with respect to FIGS. 1 and 2. The side walls 72A, 72B extend beyond the angled bottom portions 16A, 16B and are secured to the mounting bracket 20. This forms a rigid connection and angled relationship between the mounting bracket 20 and the rest of the dispenser 10. Each of the front wall portions 12A, 12B terminate at a lower end with a bottom edge 13. The dispensing slot 36 is defined between the bottom edges 13 and the lips 38 of the angled bottom portions 16A, 16B.

Figure 6:
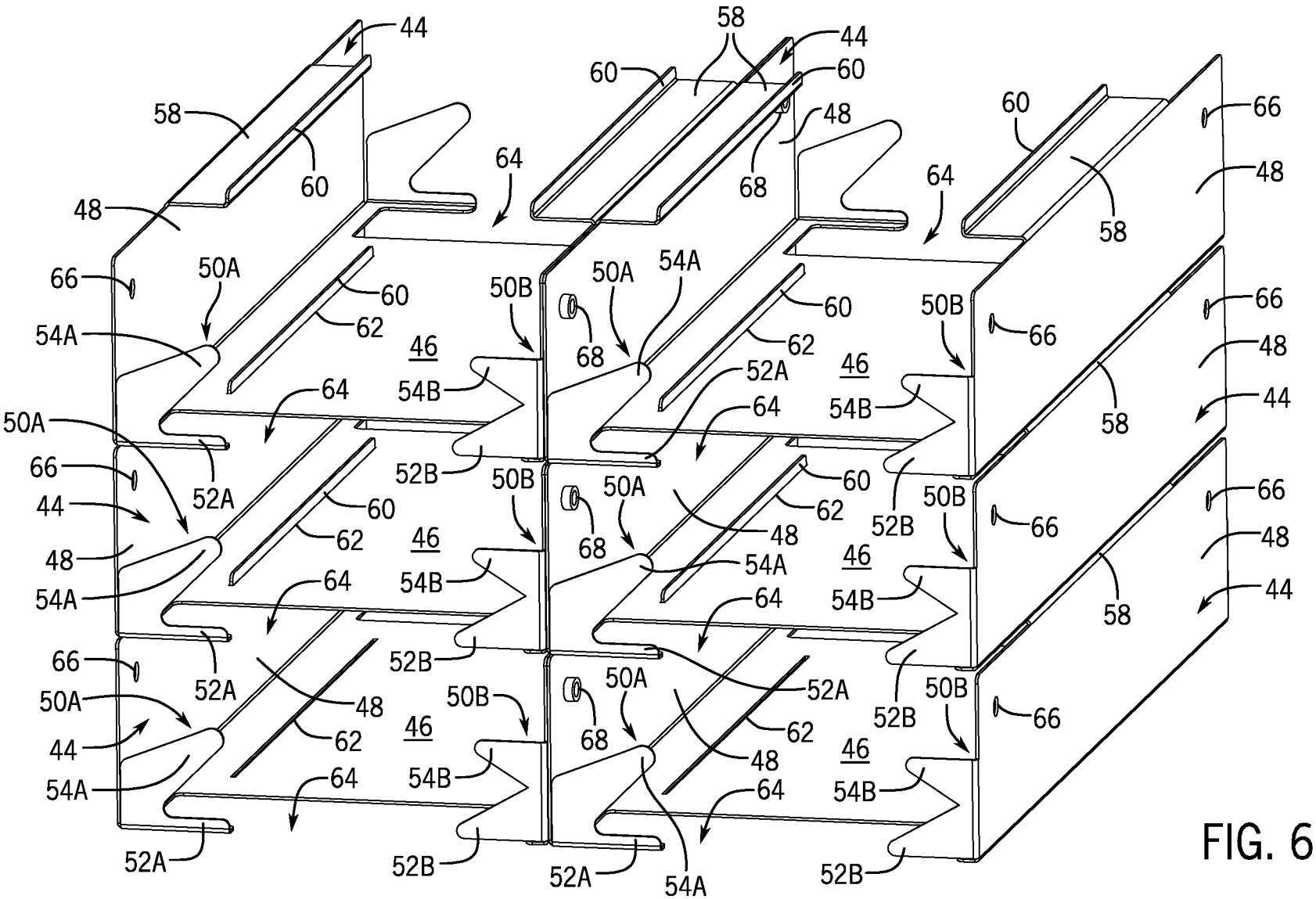
FIG. 6 is a perspective view an exemplary embodiment of an assembly of wrapper dispensers.
Figure 7:
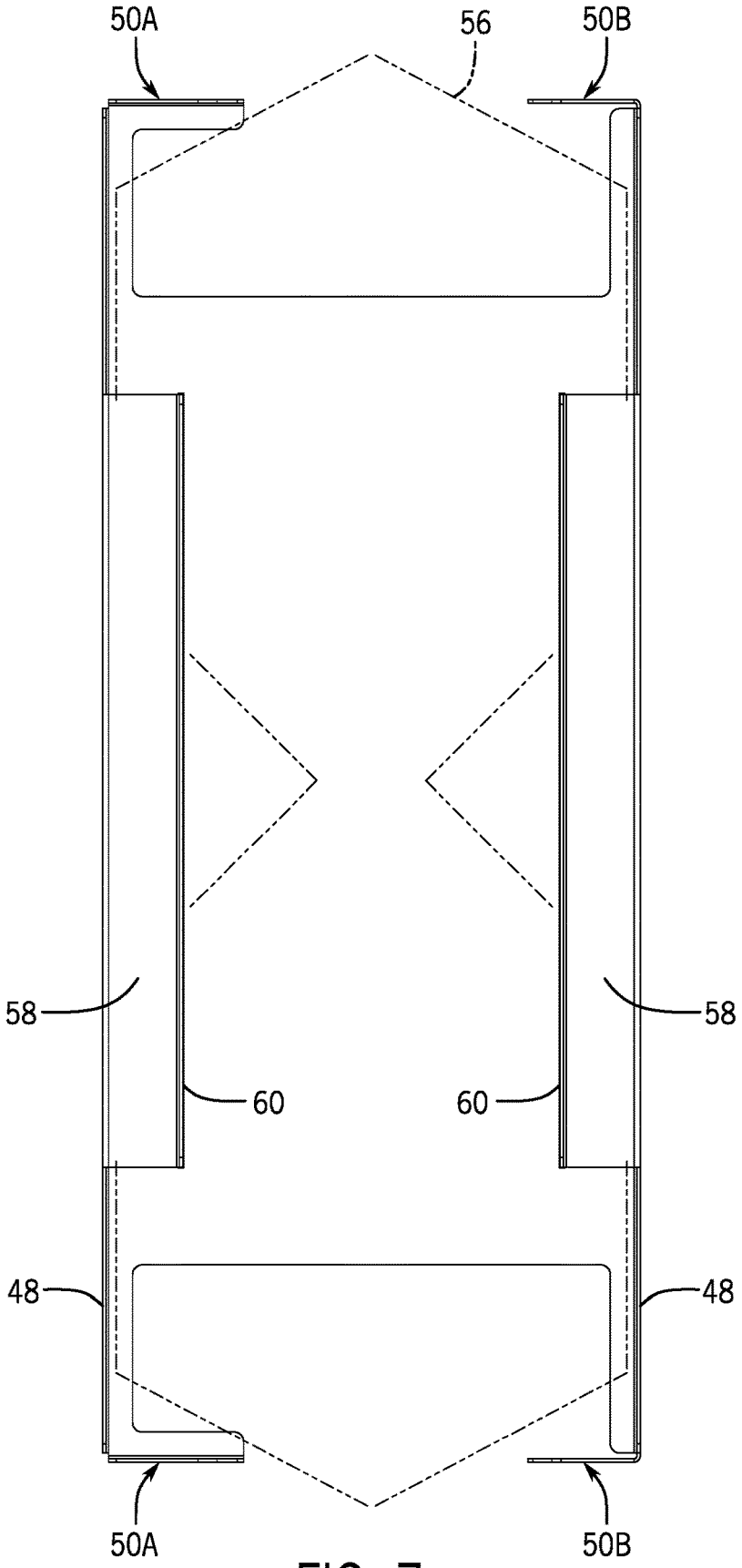
FIG. 7 is a top view of an exemplary embodiment of a wrapper dispenser.
Figure 8:
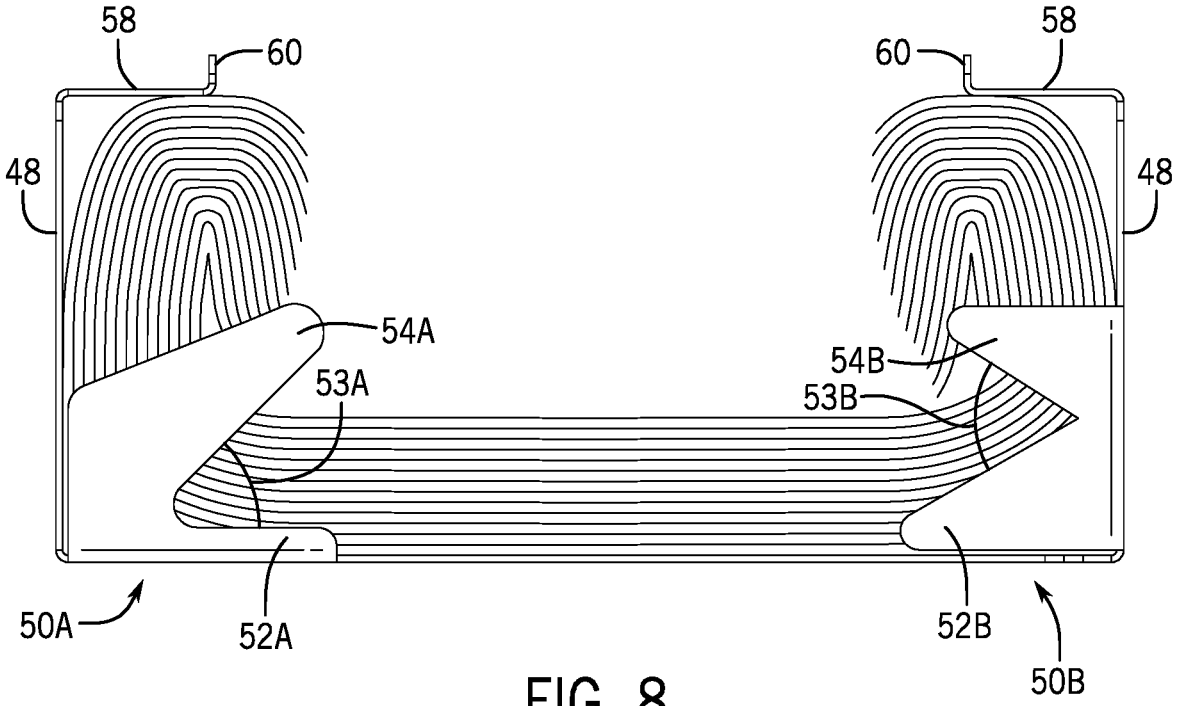
FIG. 8 is a front view of the wrapper dispenser loaded with wrappers.

FIGS. 6-8 depict an exemplary embodiment of a food wrapper dispenser 44. FIG. 6 depicts a plurality of food wrapper dispensers 44 in an interconnected arrangement. Each food wrapper dispenser 44 includes a floor 46 and side walls 48. The food wrapper dispensers 44 further include opposed end finger assemblies 50A, 50B. The food wrapper dispensers 44 exemplarily include the opposed end finger assemblies 50A, 50B at each end of the dispensers 44 such that food wrappers 56 (FIGS. 7,8) can be removed from either end of the dispensers 44.

The opposed end finger assemblies 50A and 50B are exemplarily asymmetrical in construction from one another. In the embodiment depicted, a first end finger assembly 50A includes a lower finger 52A that extends in generally horizontal direction. The first end finger assembly 50A further includes an upper finger 54A at a position above the lower finger 52A. The upper finger 54A is angled relative to the lower finger 52A. The lower finger 52A and the upper finger 54A exemplarily form an interior angle 53A of 45 degrees. The ends of the upper finger 54A and the lower finger 52A may extend the same distance such that the space between the upper finger 54A and the lower finger 52A generally forms a right angle. In contrast, the second end finger assembly 50B includes a lower finger 52B that is angles interiorly in a downward direction and an upper finger 54B that angles interiorly in an upward direction. The lower finger 52B and the upper finger 54B of the second end finger assembly 50B form an exemplary interior angle 53B of 60 degrees. The inventors have discovered an embodiment wherein asymmetrical end finger assemblies 50A, 50B promote withdrawing a single sheet of food wrapper from a stack of food wrappers placed within the food wrapper dispenser 44 as described herein. It will be recognized from that other embodiments of end finger assemblies 50A, 50B, including other shapes and angulation between the first and second fingers of the end finger assemblies 50A, 50B may be used while remaining within the scope of the present disclosure. For example, in another exemplary embodiment, the first and second end finger assemblies 50A, 50B may be symmetrical/mirrored from one another and have the same angle between fingers on each side. In exemplary embodiments, this angle may be between 30-60 degrees, although other angles may also be possible.

FIG. 7 is a top view of a food wrapper dispenser 44 exemplarily depicting the placement of a food wrapper 56 within the dispenser 44. FIG. 8 is a front view of a food wrapper dispenser 44 exemplarily depicting the placement of food wrappers 56 within the dispenser 44. As can be seen from FIGS. 7 and 8, the food wrappers 56 (which are exemplarily square in shape) are oriented in a diamond shape with the two side ends folded towards the middle. This is seen in the dashed outline of FIG. 7 and the side profile of FIG. 8 shows that that wrappers 56 when stacked and folded in this manner, tend to curl in upon one another. Referring to FIG. 8, a user will withdraw the top wrapper 56 from the stack of wrappers, the opposed end finger assemblies help to separate the top wrapper 56 from the rest of the stack of wrappers such that only one is withdrawn by the user. This has been found to be an improvement over other wrapper dispensers.

FIG. 6 further depicts an assembly formed of a plurality of interconnected wrapper dispensers 44. The wrapper dispensers 44 include features that promote connection of multiple dispensers 44 to form a unit that can be used to organize and dispense multiple types of wrappers. Such an assembly can be positioned on a table, a shelf, or supported from a rack or below a shelf. The wrapper dispensers include top flanges 58 that extend inwards from the side walls 48. The top flanges 58 exemplarily serve two purposes. First, the top flanges 58 help to retain the folded wrappers within the dispenser, for example as shown in FIG. 8. Secondly the top flanges 58 include projections 60 which correspond to slots 62 formed in the floor 46 of the dispenser 44. As shown in FIG. 6, the projections 60 of a dispenser 44 located at a lower position extend into and through the slots 62 in the floor 46 of the dispenser 44 positioned above. In this manner the dispensers can be vertically connected to one another. In an embodiment, the lateral positions of the projections 60 and the slots 62 can be offset from one another for example to place some tension on the engagement to further hold the dispensers 44 in connection with one another.

The wrapper dispensers 44, further include an aperture 64 located through the floor 46 in a region interior of the end finger assemblies 50A, 50B. The apertures 64 facilitate loading of the dispensers 44 with a stack of wrappers 56, especially when the dispensers 44 are stacked as, for example, depicted in FIG. 6. The aperture 64 of a dispenser 44 located above enables the stack of wrappers 56 to be inserted into the dispenser 44 below at an angle that is more advantageous for inserting the wrappers past the end finger assemblies 50A, 50B.

As further shown in FIG. 6, the dispensers 44 include holes 66 that are configured to receive fasteners 68 there through. The fasteners 68 may exemplarily be bolts and nuts, rivets, or other fasteners including, but not limited to screws, clips or snaps, as would be recognized from the present disclosure that can permanently or releasably secure laterally adjacent dispensers 44 to one another.

Figure 9:
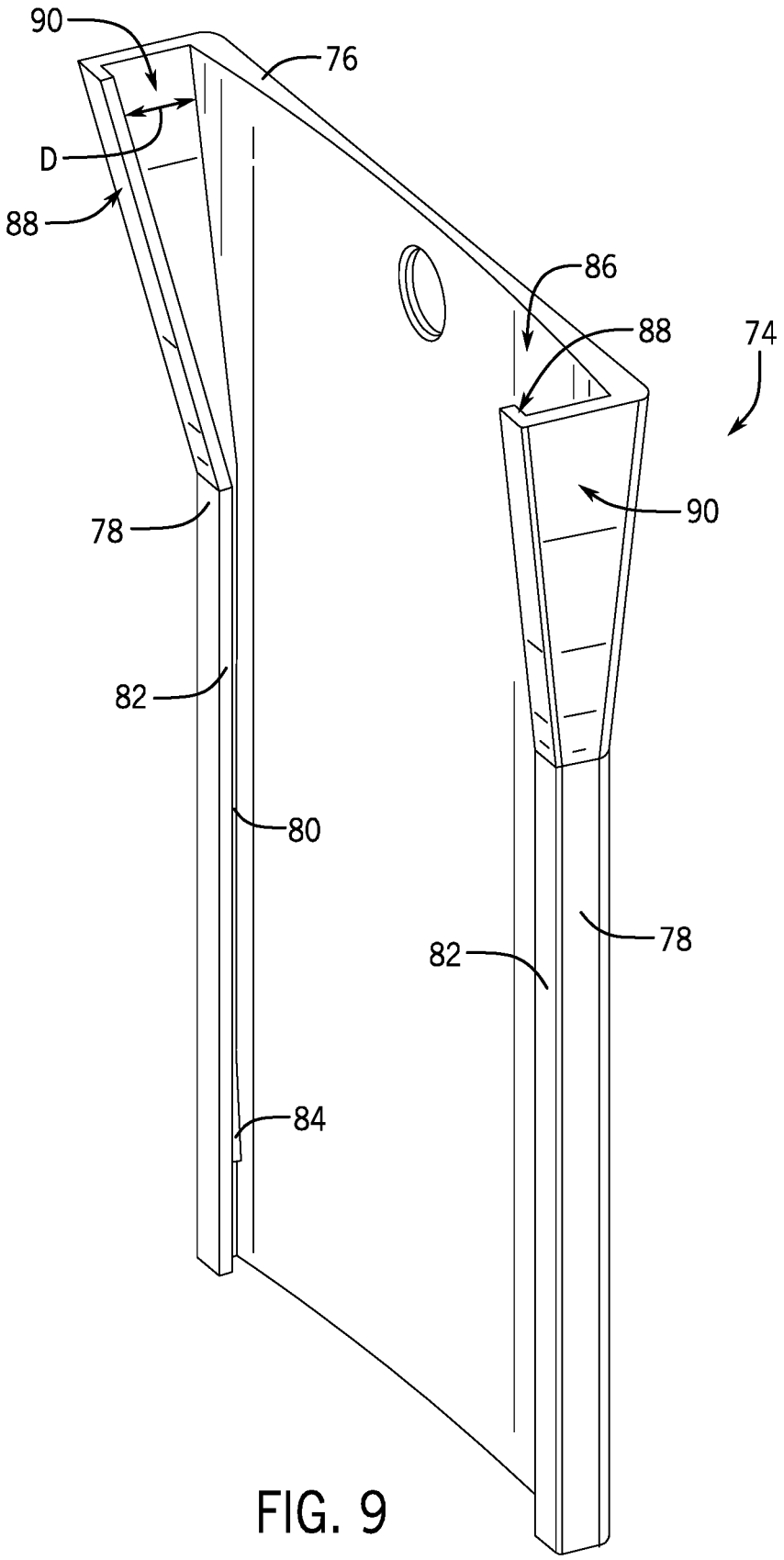
FIG. 9 is perspective view of an exemplary embodiment of a formed box dispenser.
Figure 10:
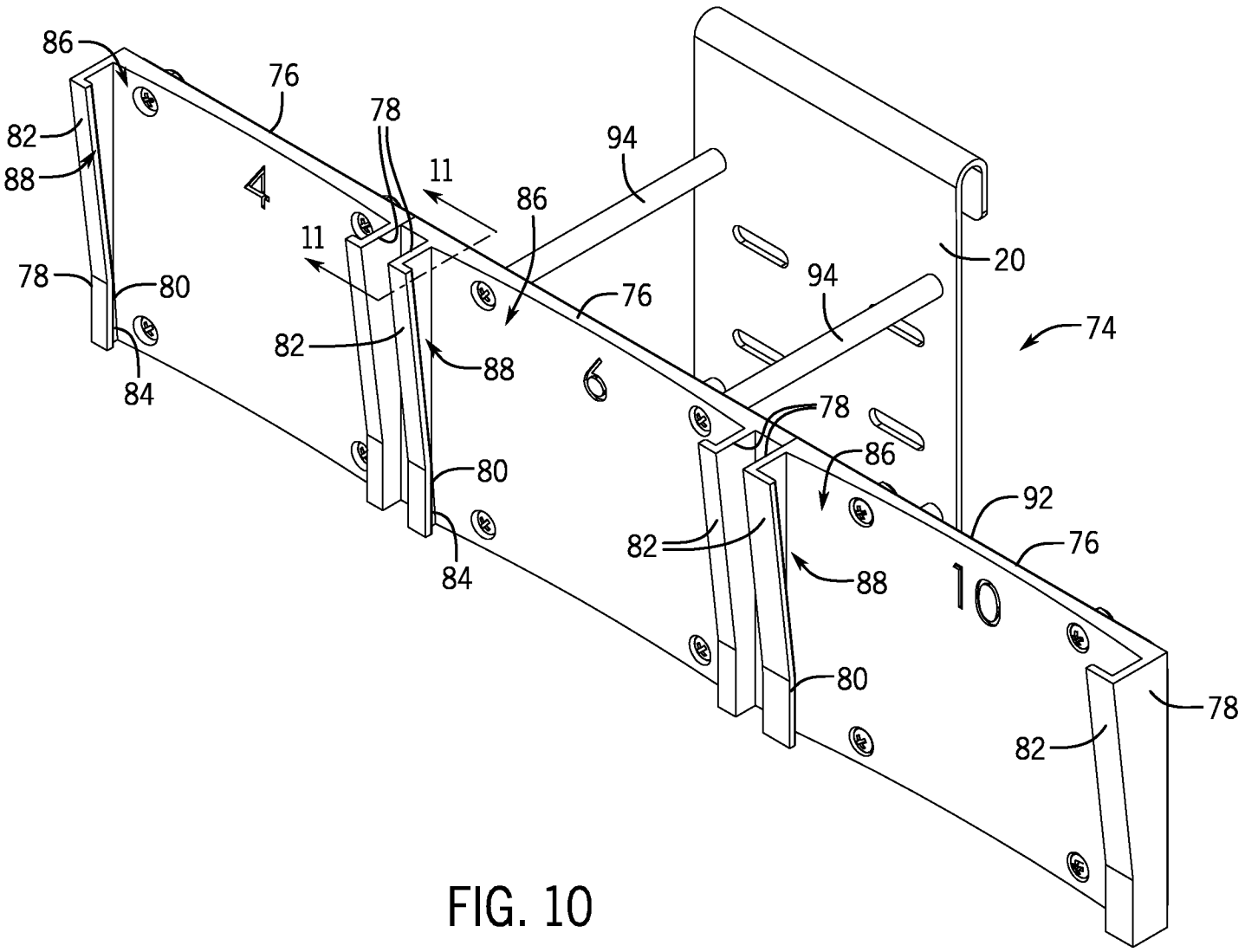
FIG. 10 is a perspective view of an exemplary embodiment of a formed box dispenser.
Figure 11:
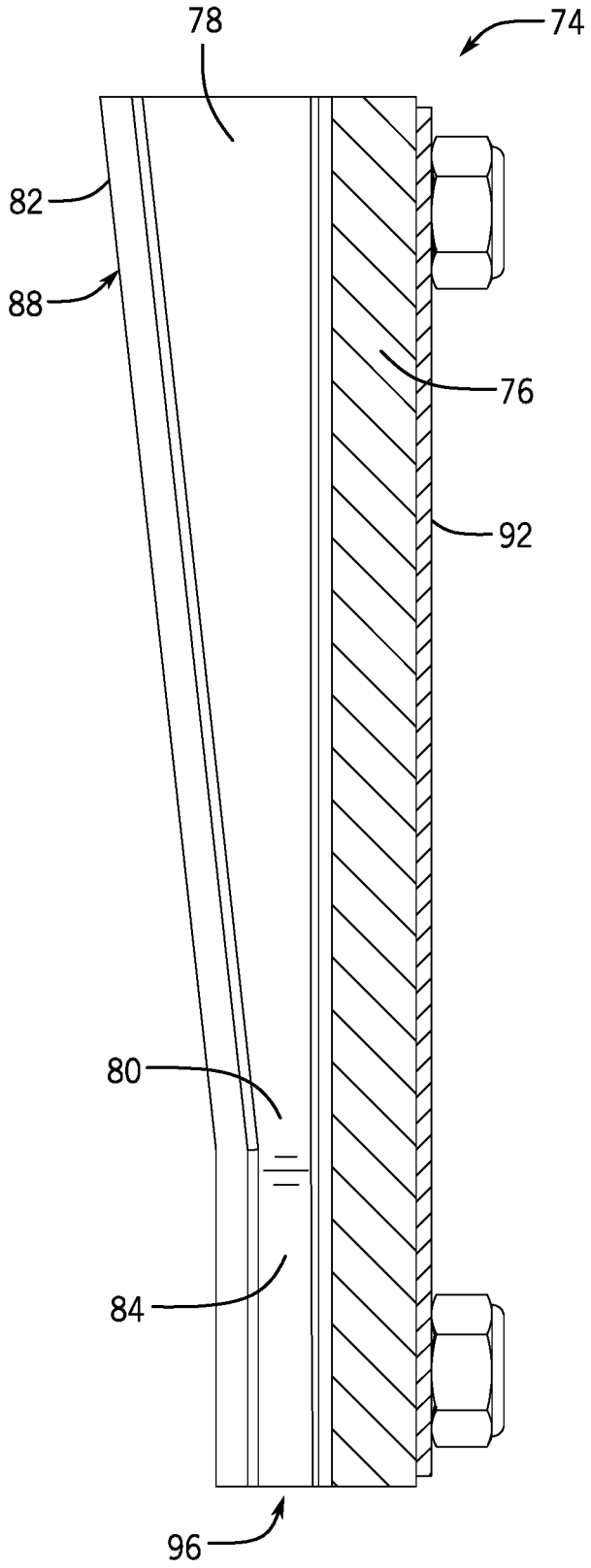
FIG. 11 is a sectional view of the formed box dispenser taken along line 11-11 of FIG. 10.

FIGS. 9-11 further depict an exemplary embodiment of a dispenser 74 for formed (e.g. assembled) boxes. The assembled boxes have a compartment and a lid, for example, as described above with respect to FIG. 4. The dispenser 74 includes a back plate 76 and two opposed side walls 78 extending from the back plate 76. The back plate 90 is exemplarily concave in shape. This helps to conform to the shape of the formed boxes and accommodates some inward flexure of the formed boxes while retained within the dispenser 74. Channels 80 are defined into the side walls 78 between an outer face 82 and the back plate 76. The channels 80 are dimensioned to receive and hold a plurality of lids of nested formed boxes. The lids of the nested formed boxes are retained between the channels 80 prior to use. The stack of nested formed boxes may extend above the top of the back plate 76, and only the lowermost boxes of the stack held within the channels 80 between the opposed side walls 78. Opposed ramps 84 are positioned within the channels 80 and place an inward force against the lids/boxes at a lower position of the dispenser 74. Upon use, a worker pulls a formed box from the bottom of the stack and the lids between the channels provides resistance such that only the bottom box of the stack is retrieved. The dimension of the channels 80 and the opposed ramps 84 help to retain the "next" box to be dispensed until a user pulls on the box to remove it from the dispenser 74. The narrowing of the channels 80 between the opposed ramps 84 places friction on the subsequent box, separating that box from the one being removed from the dispenser 74 by the user. The dispenser 74, further includes a funnel 86. The funnel 86 may include a forward flare 88 to enlarge the area of the funnel 86 in a depth dimension D compared to the distance between the back plate 76 and the front face 78. The funnel 86 may further include a side flare 90 to enlarge the area of the funnel 86 in the width dimension W compared to the distance between the side walls 78. The funnel 86 facilitates loading of boxes into the dispenser 74 by sliding boxes into the dispenser from the top.

FIG. 10 depicts the dispenser 74 for formed boxes as an arrangement of a plurality of dispensers 74. The dispenser 74 includes a plurality of back plates 76 and a plurality of side walls 78 defining channels 80 relative to each of the back plates 76. In the embodiment shown, each back plate 76 includes side walls 78 defining channels 80 that are spaced apart at different distances such as to accommodate respective different sizes of formed boxes. The back plates 76 are each secured to a support panel 92, for example with a plurality of fasteners. The support panel 92 is in turn connected to arms 94 which connect the support panel 92 to a mounting bracket 20.

FIG. 11 is a cross-sectional view of the dispenser 74 taken along line 11-11 of FIG. 10. As best shown in FIG. 11, the dispenser 74 differs from that shown in FIG. 9. The funnel 86 only includes a forward flare 88, as an example that the funnel 86 need not enlarge in multiple dimensions. The ramp 84 also starts at the end of the funnel 86 and extends for the rest of the length of the side wall 78. In this manner, the bottom end 96 of the side walls 78 and back plate 76 define the narrowest point between the side walls 78.

As noted above, in embodiments of the formed box dispenser 74, as well as other storage arrangements, a stack of nested containers may extend above the dispenser 74. This is exemplarily depicted in FIG. 12 in which a plurality of containers 102 are stacked in a nested configuration and held within a formed box dispenser 74. While depicted as boxes in FIG. 12, it will be recognized that the container covers 100 as described in further detail herein may be used with or configured for use with a plurality of other shapes of containers, including, but not limited to cups. The containers 102 are held in a nesting relationship forming a stack that extends vertically. The dispenser 74 holds the stack of containers 102 in the vertical orientation and also holds the stack at an elevated position. A kitchen worker removes a lower most container 102A from the stack by gripping the lower most container 102A and pulling the lower most container 102A downwardly away from the stack and the dispenser 74.

Figure 13:
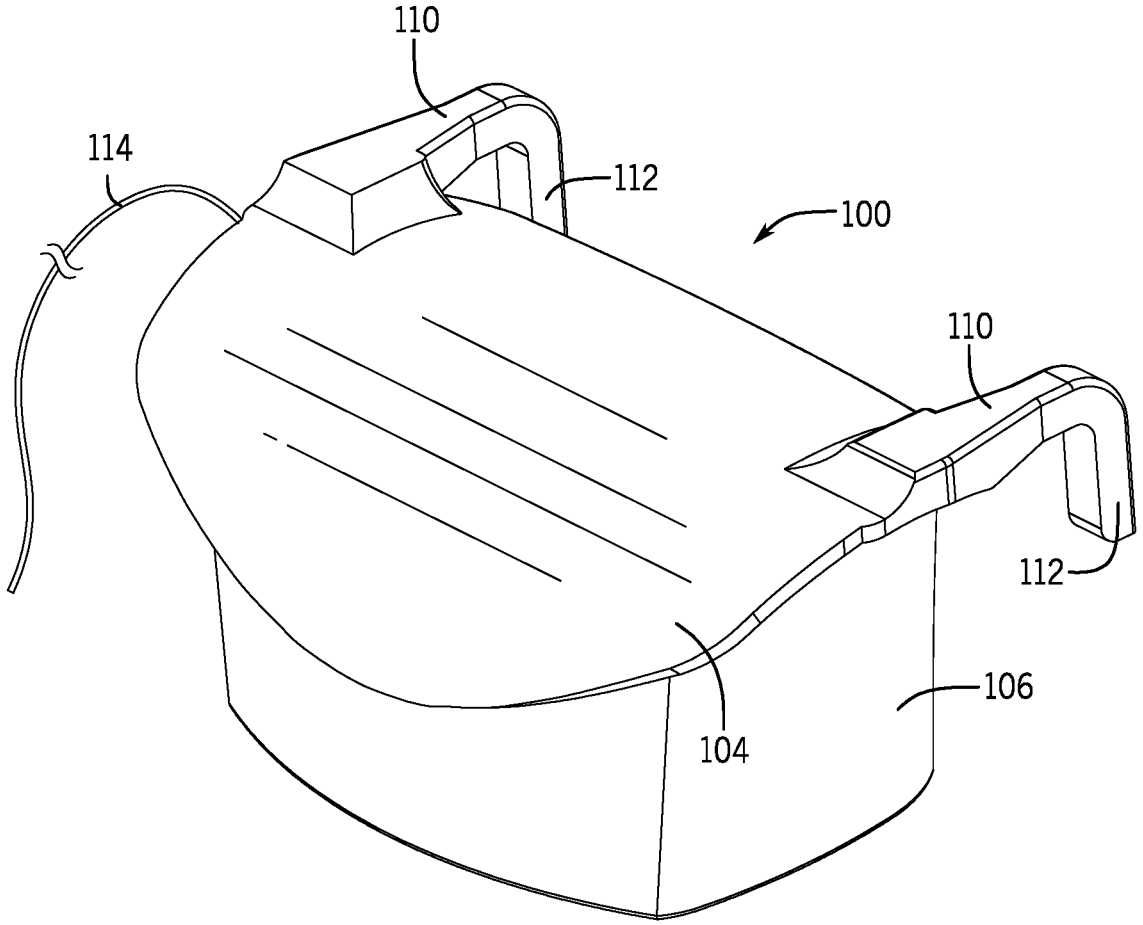
FIG. 13 is a top perspective view of an exemplary embodiment of a container cover.

Cover 100 is configured to be inserted into the top container 102B of the stack. The cover 100 serves a function of occluding the opening of the top container 102B and limiting and/or preventing collection of dust, grease, or debris in or on the containers 102 of the stack. FIG. 13 depicts an exemplary embodiment of the cover 100. The cover 100 includes a shelf 104 that extends outward from an engagement body 106 of the cover 100. The engagement body 106 is configured to be received within the opening of the top container 102B of the stack. The engagement body 106 may be configured in a variety of manners such as to be adapted to engage and protect a variety of shapes and sizes of containers. In an exemplary embodiment, the perimeter of the engagement body 106 may be dimensioned such as to snuggly fit within the opening of a smallest size container of a general shape, while the shelf 104 is dimensioned to extend beyond the outer perimeter of a largest size of a container of the same general shape. In such a manner, a single cover 100 may accommodate use with any of a variety of sizes of similarly configured containers.

The shelf 104 extends outward beyond the engagement body 106 so as to provide additional overhanging protection to the exposed rims 108 of the other containers 102 in the stack. Particularly, the shelf 104 prevents the generally downward settling of dust, grease, or debris from contacting and sticking to the containers 102 of the stack. As only the majority of the lower most container 102A of the stack is exposed, this exposure is minimized as the body of only one container 102 is exposed at a time and only for the interval between container dispenses until that lower most container 102A is dispensed.

Figure 12:
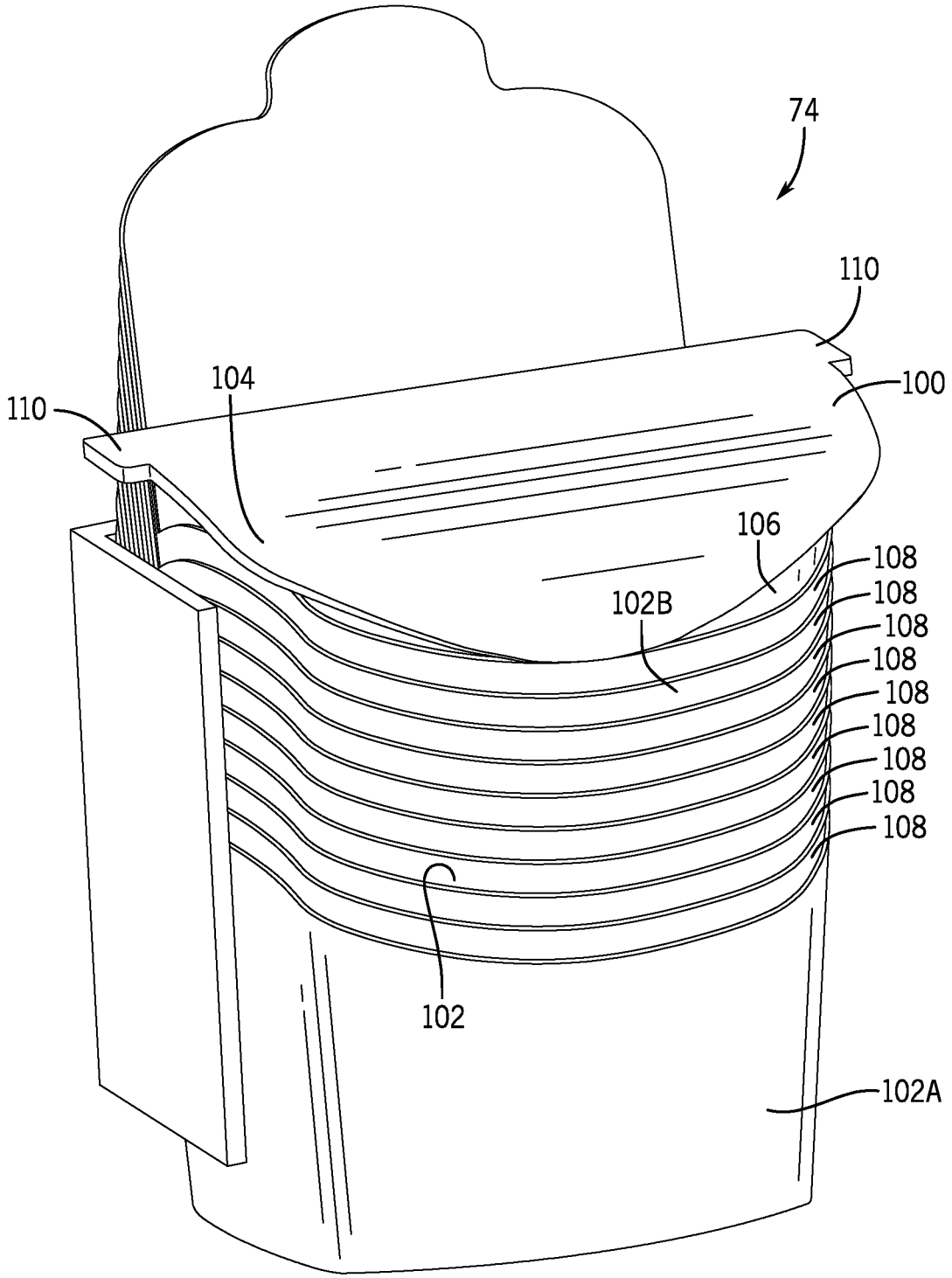
FIG. 12 depicts an exemplary embodiment of a container cover in use with a formed box dispenser.

The cover 100 further includes tabs 110 that extend outward from the engagement body 106, and in the embodiment depicted in FIG. 12, extend outward from the shelf 104. The tabs 110 are configured to extend outward beyond the perimeter of the containers 102 of the stack and further the tabs 110 are configured to engage the dispenser 74, when the stack is depleted down to a number of containers 102 such that no containers extend above the vertical extent of the dispenser 74. Engagement of the tabs 110 with the dispenser 74, separates the cover 100 from the upper most container 102B and the cover 100 is retained on the dispenser 74 until a kitchen worker replenishes the dispenser 74 with a new stack of containers 102. When the kitchen worker replenishes the supply of containers 102 in the dispenser 74, the cover 100 is again inserted into the top container 102B of the stack.

FIG. 13 depicts an embodiment of a cover 100 in which the tabs 110 extend outward from a top of the cover 100 and are exemplarily oriented rearward from the rest of the container 102. In such an embodiment, the tabs 110 include lips 112, which in combination are configured to secure the cover 100 to the dispenser 74 (not depicted) by hooking over the dispenser 74, and for example, behind of the dispenser 74. As further shown in FIG. 13, the cover 100 may include a tether 114 that connects the cover 100 to the dispenser 74. The tether 114 provides movability and flexibility such that the cover 100 can be placed in the container at the top of the stack of containers as previously described, while limiting the distance by which the cover 100 can be separated from the dispenser 74.

As previously described, the engagement body 106 is configured to fit within a container 102, but in embodiments may fit snugly within a container or may be dimensioned to fit within a smallest interior perimeter dimension of container, while the shelf 104 may be dimensioned to overhang the largest dimension of container 102. While FIG. 13 depicts rearward directed tabs 110 that include lips 112, still further embodiments may have the laterally extending tabs as depicted in FIG. 12 in combination with lips 112. While the lips 112 are depicted in FIG. 13 as extending downwardly in a single dimension, the lips 112 may be designed in other shapes so as to accommodate a portion or portions of the dispenser 74 and to do so in a resiliently engaged manner. Such embodiments may include both lateral and depth oriented lips, or may include a keyed lip that is configured to engage a mating feature on the dispenser 74 (not depicted). In still further exemplary embodiments, other forms of engagement features may be included on the lip 112 and/or the dispenser 74. Such engagement features may include a corresponding engagement feature, for example a hook, ridge, or lip that engages with the mating feature of the cover 100. In still other embodiments, a magnet or magnets located in the cover 100 may interact with a magnet or magnets in the dispenser 74 to retain the cover 100 in engagement with the dispenser 74.

Figure 14:
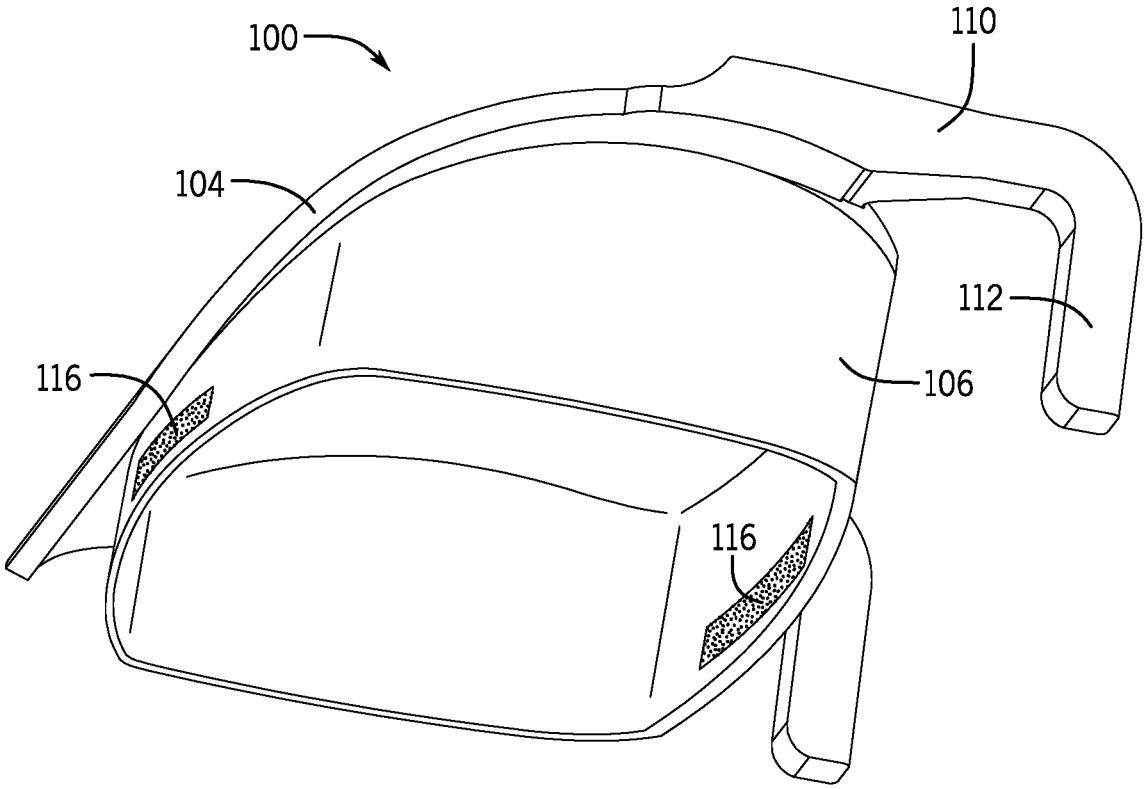
FIG. 14 is a bottom perspective view of an exemplary embodiment of a container cover.

FIG. 14 depicts an embodiment of a cover 100 in which the engagement body 106 is configured to engage to the exterior of a container. In such an embodiment, a portion of the container may fit within the engagement body 106. In an example, this may include the front of the container and an engagement flap at the top and rear of the container. In the embodiment depicted, the front of the engagement body 106 of the cover 100 is configured to fit inside of a container, while the rear of the engagement body 106 of the cover 100 is configured to fit around the outside of the flap at the top of the container. The cover 100 may further include engagement surfaces 116 to promote engagement with the container. The engagement surfaces 116 may exemplarily be made of an elastomeric material, for example that is softer or more pliable than the other material of the cover 100. In another embodiment the engagement surfaces 116 may be textured or have another feature as will be recognized to promote engagement. In an embodiment, the front engagement surface 116 is configured to engage the front interior of the container while the rear engagement surface 116 is configured to engage the exterior of the container, for example, the exterior of the flap of the container. In a still further embodiment, this arrangement may be reversed and the front of the engagement body 106 is configured to engage the exterior of the container, while the rear of the engagement body 106 is configured to engage the interior of the container. In such an embodiment, the engagement surfaces 116 may be similarly reversed in their arrangement.

Figure 15:
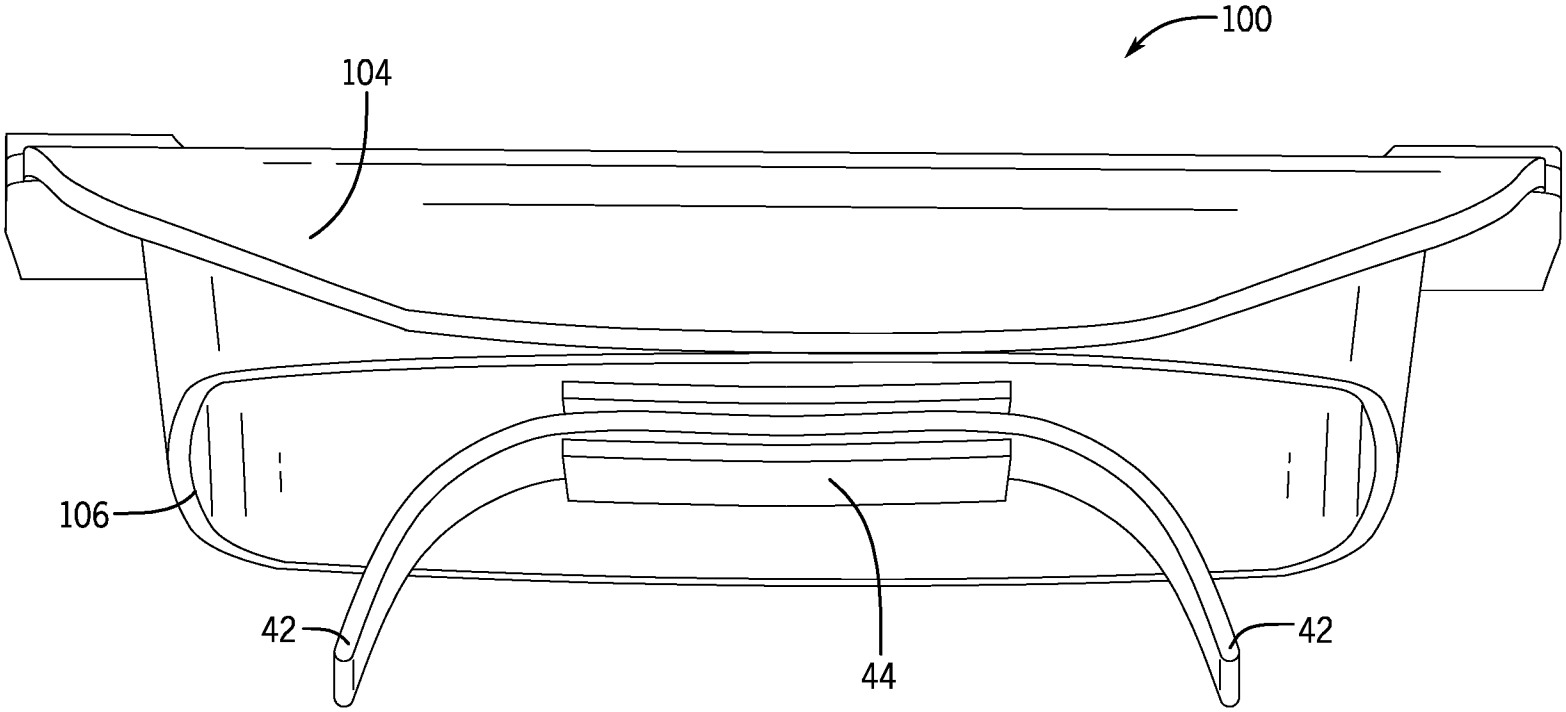
FIG. 15 is a front perspective view of an exemplary embodiment of a container cover.

FIG. 15 depicts a still further exemplary embodiment of a cover 100. The cover 100 is constructed in a similar manner as other embodiments as described herein, however, the engagement body 106 may be shorter or closer to the ledge 104 of the cover 100 than in some other embodiments. Additionally, the engagement body 106 may be configured to extend exterior of some or all of the perimeter of the container, while the engagement body 106 may extend around the front and/or sides of the container, leaving a closure flap of the container to extend rearward of the cover 100. The cover 100 further includes resilient arms 118 which are exemplarily configured to engage the interior of the container to which the cover 100 is placed. The resilient arms 118 may be received within an arm support 120 that secures the resilient arms 118 to the cover 100. The resilient arms 118 may be separate arm pieces or may be a unitary arm piece that forms one or more of the resilient arms 118. In a still further embodiment (not depicted) additional resilient arms 118 may be used, including but not limited to arms extending forward and rearward for further engagement with the container. Due to the resilient nature of the arms 118, the arms 118 can securely accommodate multiple sizes of containers, and place an outward resilient force against the container as well as locally on the stack of containers, which may help to retain the containers within the dispenser 74.

It will be recognized that other embodiments of the cover 100 apart from those as depicted in FIGS. 12-15 may be configured for use with other shapes of containers including cups and/or bowls. Further, it will be recognized that the general shape of the cover need not approximate the general cross-sectional shape of the container to which the cover engages. It will be recognized that in other embodiments, alternative shapes may be used as such may facilitate a single cover being useable with multiple sizes and or shapes of containers.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A dispenser of food product packaging in the form of a box blank arranged in a flat storage condition with a front face in contact with a rear face, the dispenser comprising:

a first side wall extending vertically;

a second side wall extending vertically;

a first arm extending away from the first side wall;

a second arm extending away from the second side wall, the first arm and the second arm configured for mounting the dispenser to an object;

a front wall extending vertically between the first side wall and the second side wall, the front wall comprising a first face portion that comprises a first bottom edge and the front wall comprising a second face portion that comprises a second bottom edge;

an angled bottom comprising a first angled portion connected to the first side wall and a second angled portion connected to the second side wall, the angled bottom spaced apart from the first bottom edge and the second bottom edge to form a dispensing slot;

a first dispenser half comprising the first side wall, the first angled portion, and the first face portion that comprises the first bottom edge; and a second dispenser half comprising the second side wall, the second angled portion, and the second face portion that comprises the second bottom edge;

wherein the first dispenser half and the second dispenser half define a dispenser interior dimensioned to receive a plurality of box blanks in the flat storage condition.

2. The dispenser of claim 1, further comprising a back wall, wherein the first side wall, second side wall, front wall, and angled bottom are formed of a single piece of material.

3. The dispenser of claim 1, wherein the dispensing slot extends in a vertical dimension a distance commensurate with a combined thickness of a folded box front face in contact with the rear face.

4. The dispenser of claim 1, wherein the first arm is pivotably attached to the first side wall and the second arm is pivotably attached to the second side wall.

5. The dispenser of claim 1, wherein the first arm is integrally formed with the first side wall and the second arm is integrally formed with the second side wall.

6. The dispenser of claim 1, further comprising a mounting bracket, wherein the first arm and second arm are secured to the mounting bracket and the mounting bracket is configured to mount the dispenser to the object.

7. The dispenser of claim 1, wherein the first dispenser half is laterally separated from the second dispenser half.

8. The dispenser of claim 7, further comprising:

a mounting bracket configured to secure the dispenser to an object; and wherein the first dispenser half comprises the first arm and the second dispenser half comprises the second arm, and the first and second arms are secured to the mounting bracket to define a space between the first dispenser half and the second dispenser half associated with a size of the box blank to be received therein.

9. A dispenser of food product packaging in the form of a wrapper, the dispenser comprising:

a first side wall extending vertically;

a second side wall extending vertically and opposed from the first side wall;

a floor extending horizontally between the first and second side walls;

a first end finger assembly extending from an end of the first side wall in the direction of the second side wall;

a second end finger assembly extending from an end of the second side wall in the direction of the first side wall;

a first flange extending inwardly from a top of the first side wall in the direction of the second side wall; and a second flange extending inwardly from a top of the second side wall in the direction of the first side wall;

wherein the first and second flanges are configured to engage respective portions of the wrapper to deflect the respective portions of the wrapper towards an interior of the dispenser defined by the first and second side walls and the floor; and wherein the first end finger assembly is asymmetrical in construction from the second end finger assembly and the first and second end finger assemblies are configured to engage the wrapper to resist removal of the wrapper from between the first and second side walls.

10. The dispenser of claim 9, wherein the dispenser is a first dispenser and is configured to interconnect with a second dispenser and the first dispenser further comprises:

projections that extend upward from the first and second flanges; and slots formed in the floor, the slots parallel to the first and second side walls, wherein the slots are configured to receive and retain projections from the second dispenser when the second dispenser is positioned below the floor of the first dispenser.

11. The dispenser of claim 9, further comprising a third end finger assembly extending from an end of the first side wall opposite the first end finger assembly in the direction of the second wall and a fourth finger assembly extending from an end of the second side wall opposite the second end finger assembly in the direction of the first side wall.

12. The dispenser of claim 9, wherein the first end finger assembly comprises a horizontally extending lower finger and upwardly angled upper finger.

13. The dispenser of claim 12, wherein the second end finger assembly comprises a downwardly angled lower finger and an upwardly angled upper finger.

14. A dispenser of food product packaging in the form of a box having a compartment and a closure flap, the dispenser comprising:

a back plate;

first and second side walls extending outward from edges of the back plate;

a funnel with first and second forward flares that extend in a direction away from the back plate in a depth dimension;

a first channel defined into the first side wall between the back plate and a front face of the first side wall; and a second channel defined into the second side wall between the back plate and a front face of the second side wall.

15. The dispenser of claim 14, further comprising a first ramp located within the first channel and a second ramp located within the second channel, wherein the first and second ramps narrow a lateral distance between the first and second side walls.

16. The dispenser of claim 14, further comprising a cover that comprises:

an engagement body to be inserted into the compartment;

a shelf that extends outward from an outer extent of the engagement body; and at least one tab that is configured to engage the back plate or side walls to retain the cover thereto.

* * * * *